US007839373B2

(12) United States Patent
Yasuda et al.

(10) Patent No.: US 7,839,373 B2
(45) Date of Patent: Nov. 23, 2010

(54) DISPLAY DEVICE

(75) Inventors: Kozo Yasuda, Mobara (JP); Katsumi Matsumoto, Mobara (JP)

(73) Assignee: Hitachi Displays, Ltd., Chiba-ken (JP)

( * ) Notice: Subject to any disclaimer, the term of this patent is extended or adjusted under 35 U.S.C. 154(b) by 50 days.

(21) Appl. No.: 12/155,357

(22) Filed: Jun. 3, 2008

(65) Prior Publication Data

US 2008/0303762 A1 Dec. 11, 2008

(30) Foreign Application Priority Data

Jun. 5, 2007 (JP) ..... 2007-148974

(51) Int. Cl.
*G09G 3/18* (2006.01)

(52) U.S. Cl. ..... 345/98; 345/211; 345/212

(58) Field of Classification Search ..... None
See application file for complete search history.

(56) References Cited

U.S. PATENT DOCUMENTS 6,317,344 B1 * 11/2001 Koizumi et al. ..... 363/60
2002/0196223 A1 * 12/2002 Takahashi et al. ..... 345/90
2003/0218593 A1 * 11/2003 Inoue et al. ..... 345/92
2006/0221033 A1 10/2006 Yasuda et al.

* cited by examiner

*Primary Examiner*—Amare Mengistu
*Assistant Examiner*—Antonio Xavier
(74) *Attorney, Agent, or Firm*—Stites & Harbison, PLLC; Juan Carlos A. Marquez, Esq

(57) ABSTRACT

A display device which arranges a memory part for every display pixel is configured to prevent a charge from remaining in liquid crystal when a power source is turned off. Each display pixel includes a memory part for storing video data, a pixel electrode, and a switch part for selectively applying a first video voltage or a second video voltage different from the first video voltage to the pixel electrode corresponding to the video data stored in the memory part. The display device further includes a reset circuit for allowing the first video voltage and the second video voltage to have the same voltage when a power source of the display device is turned off.

11 Claims, 5 Drawing Sheets

DISPLAY DEVICE

The present application claims priority from Japanese applications JP2007-148974 filed on Jun. 5, 2007, the content of which is hereby incorporated by reference into this application.

BACKGROUND OF THE INVENTION

1. Field of the Invention

The present invention relates to a display device such as a liquid crystal display device or an EL display device, and more particularly to a display device which arranges a memory in each display pixel.

2. Related Art

There has been known a highly-functional liquid crystal display device of low power consumption which arranges a memory in each display pixel in a liquid crystal display panel, and stores display data in each memory thus displaying an image on a liquid crystal display panel even when there is no input signal from the outside (see JP-A-2006-285118 (patent document 1)).

SUMMARY OF THE INVENTION

Generally, in a liquid crystal display device, when a charge remains in liquid crystal of a liquid crystal display panel, the remaining charge causes burn-in or image retention. Accordingly, it is necessary to prevent the charge from remaining in the liquid crystal when a power source is turned off.

Also in the liquid crystal display device which arranges a memory part for each display pixel, it is necessary to prevent a charge from remaining in liquid crystal when a power source is turned off. However, patent document 1 fails to disclose the constitution for preventing the charge from remaining in the liquid crystal when the power source is turned off.

The invention has been made to overcome the above-mentioned drawbacks of the related art, and it is an object of the invention to provide a technique which can prevent a charge from remaining in liquid crystal by setting a potential difference between voltages applied to both ends of the liquid crystal to 0V when a power source is turned off in a display device which arranges a memory part for every display pixel.

The above-mentioned and other objects and novel features of the invention will become apparent from the description of this specification and attached drawings.

To briefly explain the summary of typical inventions among inventions disclosed in this specification, they are as follows.

(1) In a display device including a display panel which has a plurality of display pixels, video lines for applying video data to the respective display pixels, and scanning lines for applying a scanning voltage to the respective display pixels, each display pixel including a memory part for storing the video data, a pixel electrode and a switch part for selectively applying a first video voltage or a second video voltage different from the first video voltage to the pixel electrode corresponding to the video data stored in a memory part, the display device further includes a reset circuit which allows the first video voltage and the second video voltage to have the same voltage when a power source of the display device is turned off.

(2) In the display device having the constitution (1), the reset circuit allows the first video voltage and the second video voltage to have the same voltage when a reset signal becomes effective.

(3) In the display device having the constitution (2), the display device includes a power source circuit which generates an internal power source voltage based on an external power source voltage inputted from the outside, and turns off the internal power source voltage after a lapse of predetermined time from a point of time that the external power source voltage is turned off, wherein the external power source voltage is used as a reset signal.

(4) In the display device having any one of the constitutions (1) to (3), the display device includes a common electrode facing the pixel electrodes in an opposed manner, and a first video voltage is applied to the common electrode.

(5) In the display device having the constitution (4), a magnitude of the first video voltage and a magnitude of the second video voltage are exchanged at a predetermined cycle.

(6) In the display device having any one of the constitutions (1) to (5), the memory part is constituted of a first inverter circuit having an input terminal thereof connected to the first node and an output terminal thereof connected to the second node, and a second inverter circuit having an input terminal thereof connected to the second node and an output terminal thereof connected to the first node.

(7) In the display device having the constitution (6), the display device includes a first switching element which is turned off when a non-selective scanning voltage is applied to the scanning line and is turned on when a selective scanning voltage is applied to the scanning line, and applies video data applied to the video line to the first node.

(8) In the display device having the constitution (6) or (7), the switch part is constituted of a second switching element which is turned off when a voltage of the first node assumes a second state and is turned on when the voltage of the first node assumes a first state, and applies a first video voltage to the pixel electrode, and a third switching element which is turned off when a voltage of the second node assumes the second state and is turned on when the voltage of the second node assumes the first state, and applies a second video voltage to the pixel electrode.

(9) In the display device having any one of the constitutions (1) to (8), the display device is a liquid crystal display device.

To briefly explain advantageous effects obtained by typical inventions among the inventions disclosed in this specification, they are as follows.

According to the invention, the display device which arranges the memory part for every display pixel can prevent a charge from remaining in liquid crystal by setting a potential difference between voltages respectively applied to both ends of the liquid crystal to 0V when the power source is turned OFF.

DESCRIPTION OF THE PREFERRED EMBODIMENTS

Hereinafter, an embodiment of the invention is explained in detail in conjunction with drawings.

Here, in all drawings for explaining the embodiments, parts having same functions are given same symbols and their repeated explanation is omitted.

Embodiment 1

Figure 1:
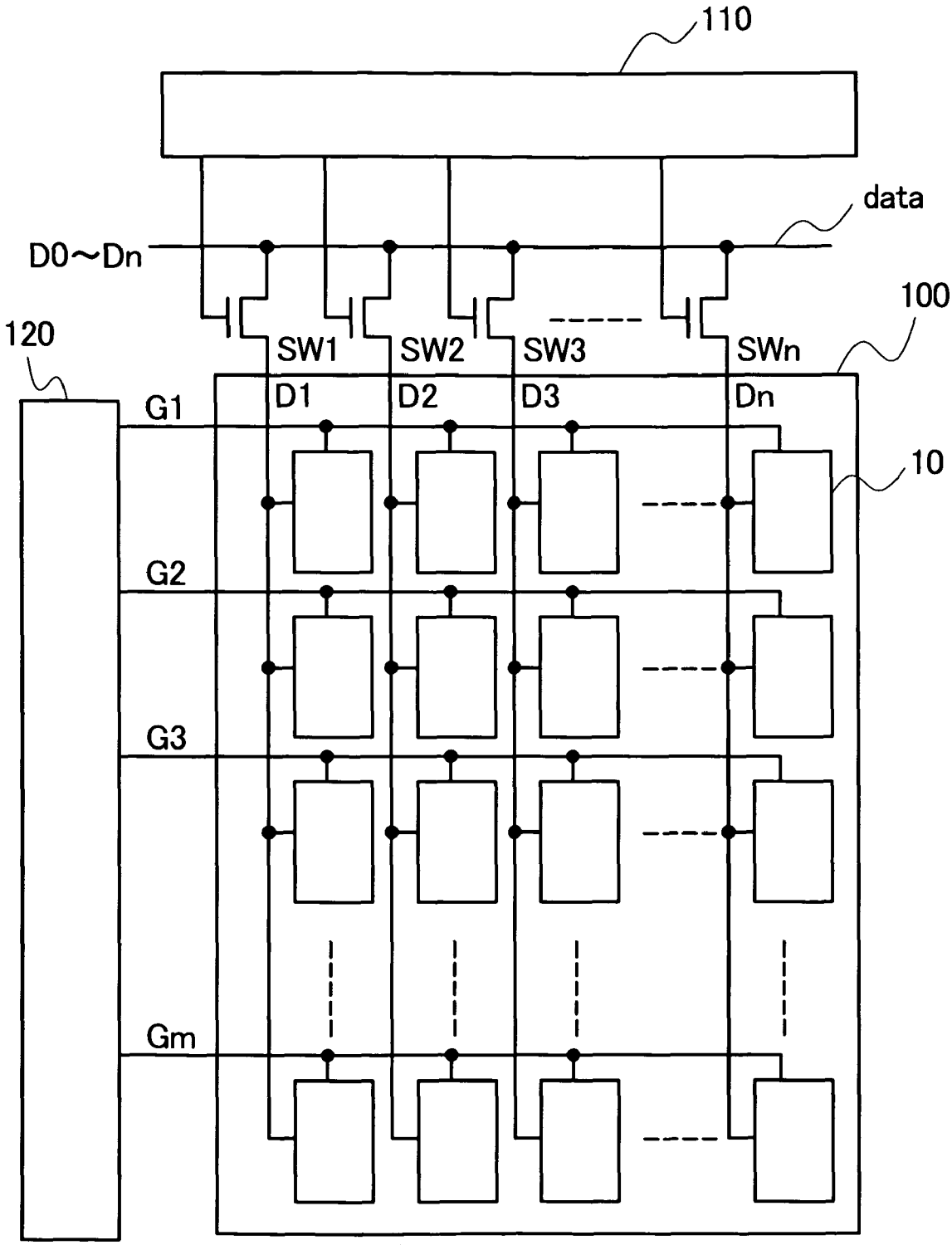
FIG. 1 is a block diagram showing the schematic constitution of a liquid crystal display device of an embodiment of the invention.

FIG. 1 is a block diagram showing the schematic constitution of a liquid crystal display device of an embodiment 1 of the invention.

In FIG. 1, numeral 100 indicates a display part, numeral 110 indicates a horizontal shift register circuit (also referred to as a video line shift register circuit), numeral 120 indicates a vertical shift register circuit (also referred to as a scanning line shift register circuit), and numeral 10 indicates display pixels.

The display part 100 includes a plurality of display pixels 10 which are arranged in a matrix array, video lines (also referred to as drain lines) D (D1, D2, D3, . . . Dn) which supply display data to the respective display pixels 10, and scanning lines (also referred to as gate lines) G (G1, G2, G3, . . . Gm) which supply scanning signals to the respective display pixels 10.

Figure 2:
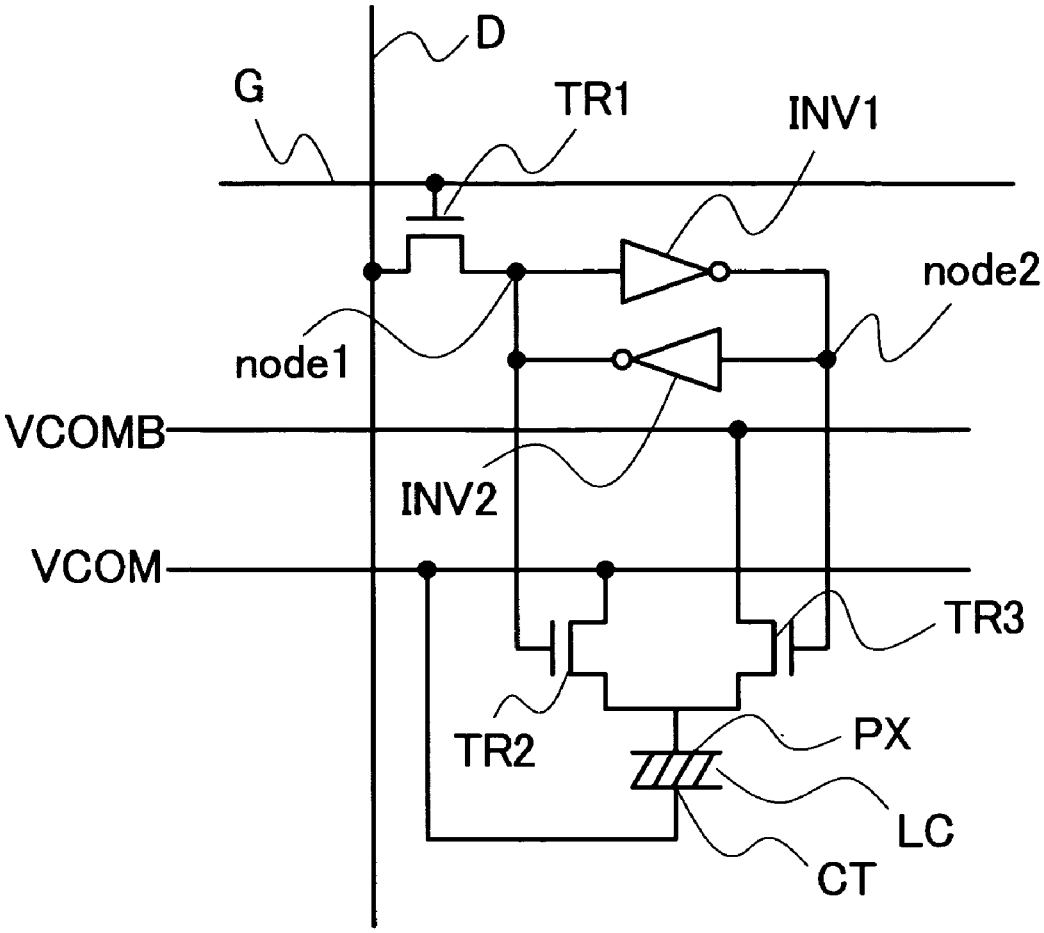
FIG. 2 is a circuit diagram showing an equivalent circuit of a display pixel shown in FIG. 1.

FIG. 2 is a circuit diagram showing an equivalent circuit of the display pixel 10 shown in FIG. 1.

In the drawing, a first inverter circuit (INV1) and a second inverter circuit (INV2) constitute a memory part.

The first inverter circuit (INV1) has an input terminal thereof connected to a first node (node 1) and an output terminal thereof connected to a second node (node 2). Further, the second inverter circuit (INV2) has an input terminal thereof connected to the second node (node 2) and an output terminal thereof connected to the first node (node 1).

A drain of an n-type transistor (TR1; a first switching element of the invention) is connected to the first node (node 1) and a gate of the n-type transistor (TR1) is connected to the scanning line (G).

Accordingly, when a selective scanning voltage (for example, H level) is applied to the scanning line (G), the n-type transistor (TR1) is turned on so that data ("1" or "0") applied to the video line (D) is written in the first node (node 1). That is, the data writing operation is performed.

Further, when a non-selective scanning voltage (for example, L level) is applied to the scanning line (G), the n-type transistor (TR1) is turned off so that a data value written in the first node (node 1) is held in the memory part constituted of the first inverter circuit (INV1) and the second inverter circuit (INV2). That is, the data holding operation is performed.

An n-type transistor (TR2; a second switching element of the invention) which has a gate thereof connected to the first node (node 1) is turned on when the voltage of the first node (node 1) assumes an H level so that a first video voltage (here, a voltage VCOM applied to a common electrode (CT)) is applied to a pixel electrode (PX).

An n-type transistor (TR3; a third switching element of the invention) which has a gate thereof connected to the second node (node 2) is turned on when the voltage of the second node (node 2) assumes an H level so that a second video voltage (here, a voltage VCOMB acquired by inverting the voltage VCOM applied to the common electrode (CT) by the inverter) is applied to the pixel electrode (PX).

The relationship between the first node (node 1) and the second node (node 2) is set such that signal levels of these nodes are inverted from each other. That is, when the voltage of the first node (node 1) assumes an H level, the voltage of the second node (node 2) assumes an L level and hence, the n-type transistor (TR2) is turned on and the n-type transistor (TR3) is turned off. Further, when the voltage of the first node (node 1) assumes an L level, the voltage of the second node (node 2) assumes an H level and hence, the n-type transistor (TR2) is turned off and the n-type transistor (TR3) is turned on.

In such a manner, a switch part (constituted of two transistors (TR2, TR3) of the same conductive type, for example) selectively applies the first video voltage or the second video voltage to the pixel electrode (PX) corresponding to data stored in the memory part (data written in the memory part from the video line (D)).

Liquid crystal (LC) is driven by an electric field generated between the pixel electrode (PX) and the common electrode (also referred to as a counter electrode) (CT) arranged to face the pixel electrode (PX) in an opposed manner. Here, the common electrode (CT) may be formed on the same substrate on which the pixel electrode (PX) is formed or may be formed on a substrate different from the substrate on which the pixel electrode (PX) is formed.

Transistors which constitute the inverter circuits (INV1, INV2) and transistors (TR1, TR2, TR3) are formed of a thin film transistor which uses poly-silicon as a material of a semiconductor layer.

The horizontal shift register circuit 110 and the vertical shift register circuit 120 in FIG. 1 are circuits which are arranged in the inside of a liquid crystal display panel. These circuits are respectively constituted of a thin film transistor which uses poly-silicon as a material of a semiconductor layer in the same manner as the transistor which constitutes the inverter circuits (INV1, INV2) and the transistors (TR1, TR2, TR3). These thin film transistors are simultaneously formed with the transistors which constitute the inverter circuits (INV1, INV2).

In this embodiment, scanning line selective signals are sequentially outputted to the respective scanning lines (G) from the vertical shift register circuit 120 for every 1 H period (scanning period). Accordingly, the transistors (TR1) having the gates thereof respectively connected to the respective scanning lines (G) are turned on.

Further, in this embodiment, switching transistors (SW1 to SWn) are provided for every video line (D). The switching transistors (SW1 to SWn) are sequentially turned on in response to a shift output of H level outputted from the horizontal shift register circuit 110 within the 1 H period (scanning period) thus connecting the video lines (D) and the data line (data).

Due to such a connection, data ("1" or "0") applied to the video lines (D) is written in the first nodes (node 1), and an image is displayed on the display part 100.

Further, when the non-selective scanning voltage is applied to the scanning lines (G), the transistors (TR1) are turned off so that a data value written in the first nodes (nodes 1) is held in the memory parts each constituted of the first inverter circuit (INV1) and the second inverter circuit (INV2). Accordingly, an image is displayed on the display part 100 even during a period in which there is no image inputting.

For example, in this embodiment, in case of a normally-white liquid crystal display panel, when "1" is written in the first nodes (nodes 1) ("0" being written in the second node (node 2)), the liquid crystal display panel performs a "white" display, while when "0" is written in the first nodes (nodes 1)

("1" being written in the second nodes (nodes 2)), the liquid crystal display panel performs a "black" display.

In this embodiment, when it is unnecessary to rewrite an image, it is possible to stop an operation of the horizontal shift register circuit 110 and an operation of the vertical shift register circuit 120 and hence, the power consumption can be reduced.

Figure 3:
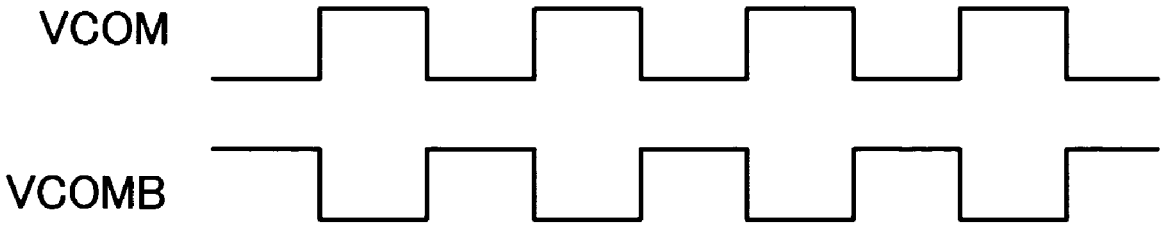
FIG. 3 is a view showing the relationship between a voltage VCOM and a voltage VCOMB obtained by inverting the voltage VCOM in the embodiment of the invention.

A common inversion drive method is adopted as an AC drive method of the liquid crystal display panel. In this embodiment, as shown in FIG. 3, it is sufficient to change the voltage VCOM (first video voltage) and the voltage VCOMB (second video voltage) which is acquired by inverting the voltage VCOM corresponding to a common inversion cycle. The voltage VCOM is inverted between an L level (for example, 0V) and an H level (for example, 5V) corresponding to the common inversion cycle. The voltage VCOMB can be generated by inverting the voltage VCOM using the inverter. When the voltage VCOM assumes an L level, the voltage VCOMB assumes an H level, while when the voltage VCOM assumes an H level, the voltage VCOMB assumes an L level. That is, a magnitude of the voltage VCOM and a magnitude of the voltage VCOMB are exchanged at a predetermined cycle.

In this embodiment, timing of the data writing operation and the inversion cycle of the common inversion drive method can be set independently from each other and hence, it is possible to provide a liquid crystal display device which possesses simple constitution and high general-use property. Further, it is unnecessary to synchronize the common inversion cycle with the timing of the data writing operation and hence, the common inversion cycle and timing of the data writing operation can be arbitrarily set. The common inversion cycle may be set, for example, for every 1 frame, for every 1 line (for every scanning period), for every plural lines (for every plural scanning periods) or the like, and may be set for other arbitrary cycle.

In general, in the liquid crystal display device, when a charge remains in the liquid crystal (LC) of the liquid crystal display panel, such a state causes burn-in or image retention. The liquid crystal display device of this embodiment is configured to prevent the charge from remaining in the liquid crystal (LC) when the power source is turned off.

In this embodiment, for preventing the charge from remaining in the liquid crystal (LC) when the power source is turned off, the voltage VCOM and the voltage VCOMB are allowed to have the same voltage when the voltage source is turned off to set a potential difference between the voltages respectively applied to both ends of the liquid crystal (LC) to 0V. Accordingly, in this embodiment, a reset circuit which allows the voltage VCOM and the voltage VCOMB to have the same voltage when the power source is turned off is provided.

Figure 4:
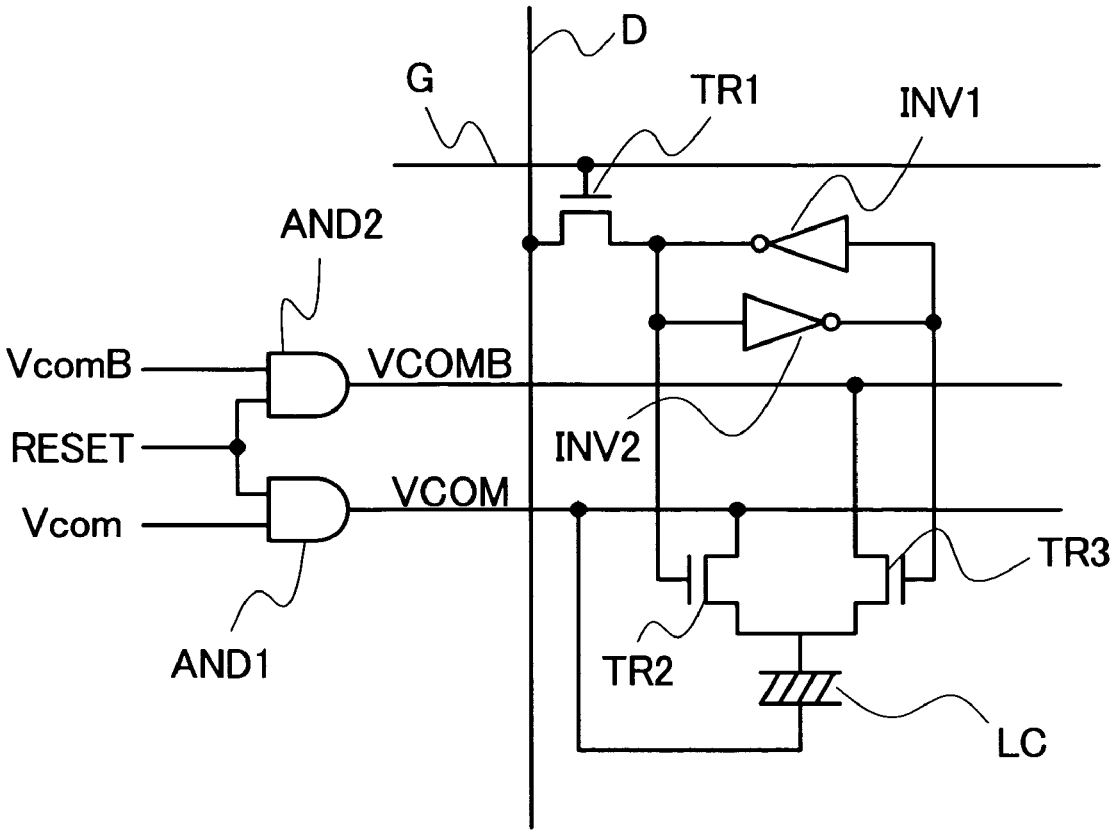
FIG. 4 is a circuit diagram showing one example of a reset circuit of the embodiment of the invention.

FIG. 4 is a circuit diagram showing one example of the reset circuit of this embodiment.

In the reset circuit shown in FIG. 4, a Vcom signal and a reset signal (RESET) generated by a logic circuit (not shown in the drawing) are inputted to an AND circuit (AND 1) and a voltage VCOM is supplied to the plurality of display pixels 10 as an output of the AND circuit (AND 1). Further, a VcomB signal and the reset signal (RESET) are inputted to an AND circuit (AND 2) and a voltage VCOMB is supplied to the plurality of display pixels 10 as an output of the AND circuit (AND 2).

In the reset circuit shown in FIG. 4, when the reset signal (RESET) assumes an L level (the reset signal being effective), the output of the AND circuit (AND 1) and the output of the AND circuit (AND 2) have the same voltage VCOMB (voltage of 0V at a Low level).

Figure 5:
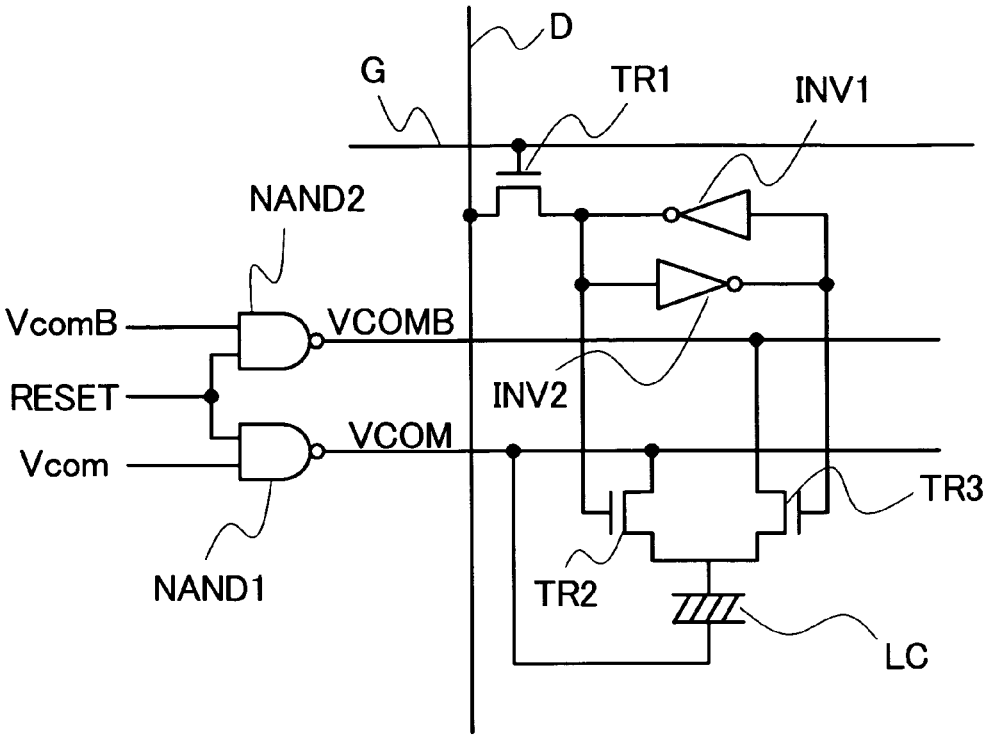
FIG. 5 is a circuit diagram showing another example of the reset circuit of the embodiment of the invention.

FIG. 5 is a circuit diagram showing another example of the reset circuit of this embodiment.

In the reset circuit shown in FIG. 5, a Vcom signal and a reset signal (RESET) generated by a logic circuit (not shown in the drawing) are inputted to a NAND circuit (NAND 1) and a voltage VCOM is supplied to the plurality of display pixels 10 as an output of the NAND circuit (NAND 1). Further, a VcomB signal and the reset signal (RESET) are inputted to a NAND circuit (NAND 2) and a voltage VCOMB is supplied to the plurality of display pixels 10 as an output of the NAND circuit (NAND 2).

In the reset circuit shown in FIG. 5, when the reset signal (RESET) assumes an L level (the reset signal being effective), the output of the NAND circuit (NAND 1) and the output of the NAND circuit (NAND 2) have the same voltage VCOM (voltage of VDD at a High level).

As described above, in this embodiment, the voltage VCOM and the voltage VCOMB are supplied to all pixels in common and hence, by merely setting the voltage VCOM and the voltage VCOMB to the same voltage (voltage of 0V or voltage of VDD), when the power source is turned off, it is possible to discharge the charge of the liquid crystal (LC) thus preventing the charge from remaining in the liquid crystal (LC).

Figure 6:
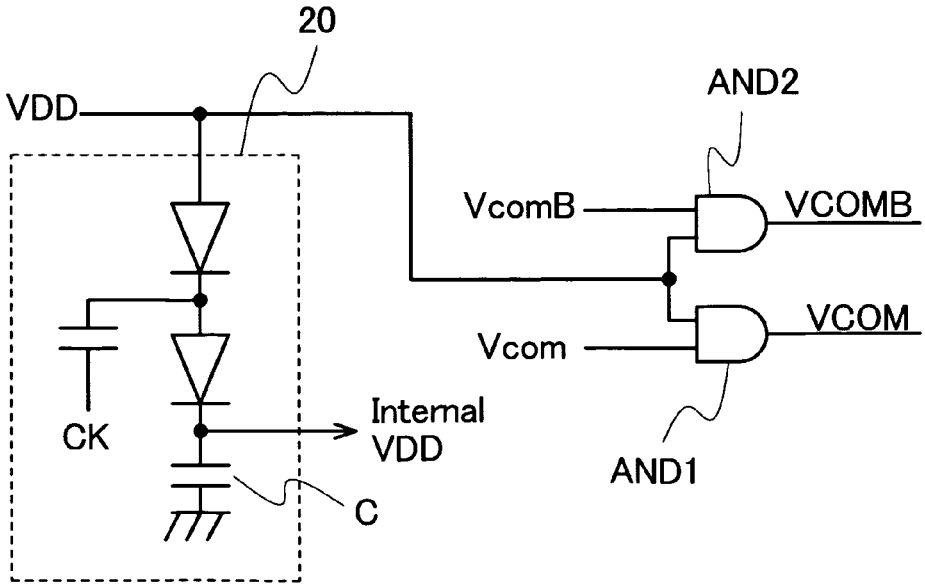
FIG. 6 is a circuit diagram showing one example of a method of generating reset signals (RESET) shown in FIG. 4 and FIG. 5.
Figure 7:
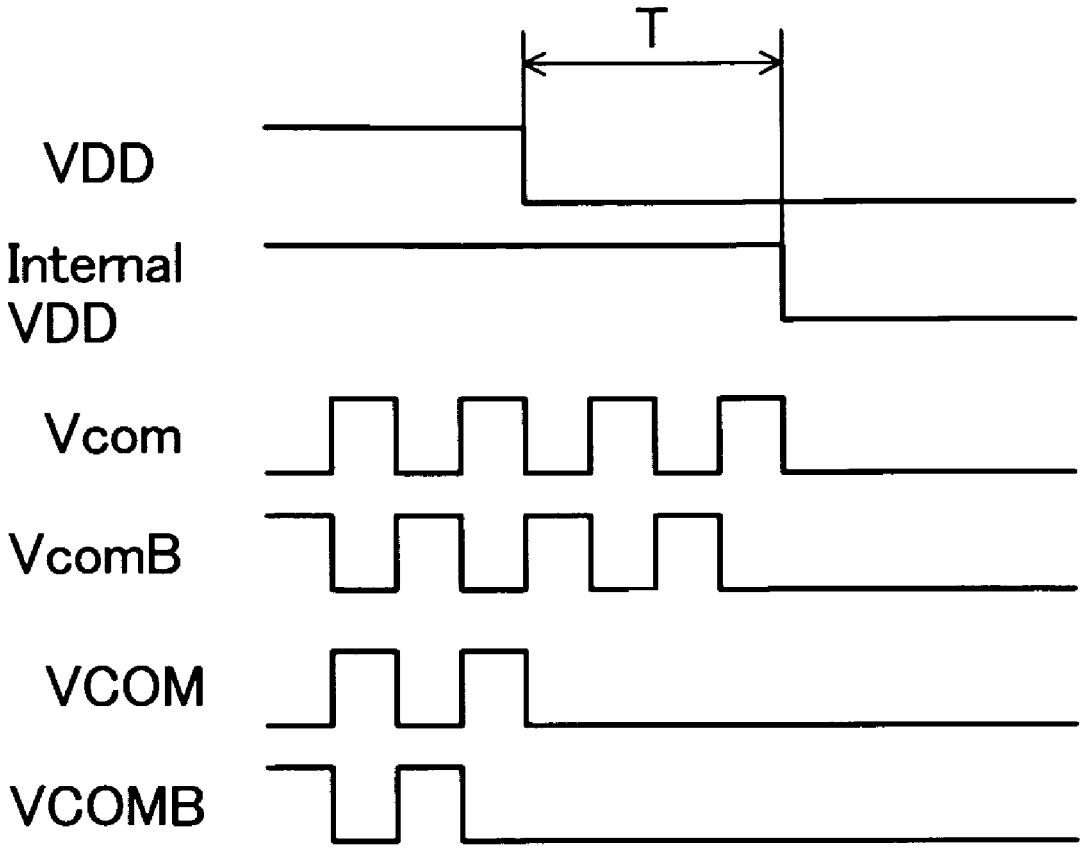
FIG. 7 is a timing chart of respective signals shown in FIG. 6.

FIG. 6 is a circuit diagram showing one example of a method of generating the reset signals (RESET) shown in FIG. 4 and FIG. 5, and FIG. 7 is a timing chart of the respective signals shown in FIG. 6.

In a circuit shown in FIG. 6, numeral 20 indicates a power source circuit (DC-DC converter) which is constituted of a diode and a capacitance. The power source circuit 20 generates an internal power source voltage (inner VDD) based on an outer power source voltage (VDD) inputted from the outside. Symbol CK indicates a clock signal.

Further, the outer power source voltage (VDD) is inputted into the AND circuits (AND 1, AND 2) as the reset signal (RESET). Accordingly, at a point of time that the outer power source voltage (VDD) is turned off, the voltage VCOM and the voltage VCOMB are allowed to have the same voltage VCOMB (a voltage of 0V at a Low level) thus discharging the charge of the liquid crystal (LC).

Further, in the power source circuit 20, due to a potential holding capacitance (C) in the power source circuit 20, as shown in FIG. 7, the internal power source voltage (inner VDD) is turned off after a lapse of a predetermined period (T) from a point of time that the outer power source voltage (VDD) is turned off. Accordingly, the internal power source voltage (inner VDD) holds a power source potential during the predetermined period (T) from a point of time that the outer power source voltage (VDD) is turned off, and the voltage Vcom and the voltage VcomB are brought into an OFF state after the lapse of the predetermined period (T).

As described in the previously-mentioned patent document 1, an X-address circuit (also referred to as a video-line address circuit) and a Y-address circuit (also referred to as a scanning-line address circuit) may be used in place of the horizontal shift register circuit 110 and the vertical shift register circuit 120 shown in FIG. 1.

In this case, it is unnecessary to take into consideration whether the voltage VCOM applied to the common electrode (CT) is at an H level or at an L level in performing the data writing operation, and it is sufficient to input data and address to the common electrode. (CT) in performing the data writing operation. Accordingly, the circuits allow the liquid crystal display panel to display an image with the same feeling produced when a usual SRAM memory is used. In this manner, these address circuits can be also used as a buffer memory of images thus reducing the number of image memories.

Further, this embodiment may also adopt an area gray scale described in the above-mentioned patent document 1. For example, one sub pixel may be constituted of four display pixels, and predetermined weighting (for example, a ratio of $1(=2^0):2(=2^1):4(=2^2):8(=2^3)$) may be applied to areas of pixel electrodes (PX) of four display pixels.

Further, in the above-mentioned embodiment, the explanation has been made with respect to the case in which the invention is applied to the liquid crystal display device. However, it is needless to say that the invention is not limited to such a liquid crystal display device, and the invention is also applicable to other display device such as an EL display device (including an organic EL display device).

Further, in the above-mentioned embodiment, the explanation has been made with respect to the case in which the peripheral circuit (for example, the drive circuit including the shift register) is incorporated in the inside of the display panel (integrally formed on the substrate of the display panel) However, the invention is not limited to such a constitution and some functions of the peripheral circuit may be performed by a semiconductor chip.

Still further, in the above-mentioned embodiment, the explanation has been made with respect to the case in which the MOS transistor is used as the thin film transistor. However, a MIS transistor having a broader definition than the MOS transistor may be used.

Although the invention made by inventors of the invention has been specifically explained in conjunction with the embodiment heretofore, it is needless to say that the invention is not limited to the above-mentioned embodiment and various modifications are conceivable without departing from the gist of the invention.

What is claimed is:

1. A display device comprising:

a display panel which has a plurality of display pixels, video lines for applying video data to the respective display pixels, and scanning lines for applying a scanning voltage to the respective display pixels, each display pixel including a memory part for storing the video data, a pixel electrode and a switch part for selectively applying a first video voltage or a second video voltage different from the first video voltage to the pixel electrode corresponding to the video data stored in the memory part; and a reset circuit which allows the first video voltage and the second video voltage to have the same voltage when an outer power source voltage for the display device is turned off, the reset circuit including a first combinational logic circuit and a second combinational logic circuit, wherein a first input signal and a reset signal are inputted to the first combinational logic circuit and the first video voltage is outputted from the first combinational logic circuit, wherein a second input signal and the reset signal are inputted to the second combinational logic circuit and the second video voltage is outputted from the second combinational logic circuit, wherein the first combinational logic circuit and the second combinational logic circuit output the same voltage when the reset signal becomes effective, and wherein the outer power source voltage is inputted to the reset circuit and a power source circuit, the power source circuit has a potential holding capacitance and at least one diode connected in series, an anode of the at least one diode is connected with the outer power source voltage, a cathode of the diode is connected with the potential holding capacitance, the power source circuit generates an internal power source voltage, the internal power source voltage is a voltage at a node between the potential holding capacitance and the diode, the internal power source voltage is turned off upon a lapse of a predetermined period of time following a time at which the outer power source voltage is turned off, the reset signal becomes effective when the outer power source voltage is turned off, and the first input signal and the second input signal are brought into an OFF state when the internal power source voltage is turned off.

2. A display device according to claim 1, wherein the reset circuit allows the first video voltage and the second video voltage to have the same voltage when the reset signal becomes effective.

3. A display device according to claim 2, wherein the external power source voltage is used as the reset signal.

4. A display device according to claim 1, wherein the display device includes a common electrode facing the pixel electrodes in an opposed manner, and the first video voltage is applied to the common electrode.

5. A display device according to claim 4, wherein a magnitude of the first video voltage and a magnitude of the second video voltage are exchanged at a predetermined cycle.

6. A display device according to claim 1, wherein the memory part of each display pixel is constituted of a first inverter circuit having an input terminal thereof connected to a first node, and an output terminal thereof connected to a second node, and a second inverter circuit having an input terminal thereof connected to the second node and an output terminal thereof connected to the first node.

7. A display device according to claim 6, wherein the display device includes a first switching element which is turned off when a non-selective scanning voltage is applied by the scanning lines and is turned on when a selective scanning voltage is applied by the scanning line, and applies the video data applied by the video line to the first node.

8. A display device according to claim 6, wherein the switch part of each display pixel is constituted of a second switching element which is turned off when a voltage of the first node assumes a second state and is turned on when the voltage of the first node assumes a first state, and applies a first video voltage to the pixel electrode, and a third switching element which is turned off when a voltage of the second node assumes the second state and is turned on when the voltage of the second node assumes the first state, and applies a second video voltage to the pixel electrode.

9. A display device according to claim 1, wherein the display device is a liquid crystal display device.

10. A display device according to claim 1, wherein both the first video voltage and the second video voltage have a high-level voltage and a low-level voltage, wherein the first combinational logic circuit is a first AND circuit and the second combinational logic circuit is a second AND circuit, wherein the reset signal has a high level signal and a low level signal and becomes effective when the reset signal is the low level signal, and wherein the first combinational logic circuit and the second combinational logic circuit output the low-level voltage when the reset signal becomes effective.

11. A display device according to claim 1, wherein both the first video voltage and the second video voltage have a high-level voltage and a low-level voltage, the first combinational logic circuit is a first NAND circuit and the second combinational logic circuit is a second NAND circuit, wherein the reset signal has a high level signal and a low-level signal and become effective when the reset signal is the low-level signal, and wherein the first combinational logic circuit and the second combinational logic circuit output the high-level voltage when the reset signal becomes effective.

* * * * *